US011217174B2

(12) United States Patent
Wang

(10) Patent No.: US 11,217,174 B2
(45) Date of Patent: Jan. 4, 2022

(54) METHOD AND DEVICE FOR COMPENSATING DISPLAY VOLTAGE

(71) Applicant: BOE Technology Group Co., Ltd., Beijing (CN)

(72) Inventor: Yu Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/765,470

(22) PCT Filed: Dec. 18, 2019

(86) PCT No.: PCT/CN2019/126209

§ 371 (c)(1),
(2) Date: Jul. 30, 2020

(87) PCT Pub. No.: WO2020/151415

PCT Pub. Date: Jul. 30, 2020

(65) Prior Publication Data

US 2021/0241691 A1 Aug. 5, 2021

(30) Foreign Application Priority Data

Jan. 24, 2019 (CN) ..... 201910067385.6

(51) Int. Cl.
*G09G 3/3258* (2016.01)

(52) U.S. Cl.
CPC ... *G09G 3/3258* (2013.01); *G09G 2320/0626* (2013.01)

(58) Field of Classification Search
CPC combination set(s) only.
See application file for complete search history.

(56) References Cited

U.S. PATENT DOCUMENTS

2012/0098877 A1 4/2012 Taro et al.
2015/0123953 A1 5/2015 Shim et al.
(Continued)

FOREIGN PATENT DOCUMENTS

CN 102456318 A 5/2012
CN 104637440 A 5/2015
(Continued)

OTHER PUBLICATIONS

International Search Report for PCT/CN2019/126209 dated Mar. 25, 2020.
(Continued)

*Primary Examiner* — Van N Chow
(74) *Attorney, Agent, or Firm* — Ling Wu; Stephen Yang; Ling and Yang Intellectual Property

(57) ABSTRACT

A method and device for compensating display voltage are disclosed in the present disclosure. The method includes: acquiring a first detected voltage and a second detected voltage corresponding to display voltages of a first preset value and a second preset value respectively, and calculating a ratio of the first detected voltage to the second detected voltage; acquiring a threshold voltage corresponding to the ratio of the first detected voltage to the second detected voltage from a preset correspondence table; acquiring a current display voltage; and calculating a compensation coefficient according to the threshold voltage; and compensating the current display voltage according to the threshold voltage and the compensation coefficient. Thus, the corresponding threshold voltage is acquired through the ratio of different detected voltages corresponding to the display voltages. The compensation coefficient is calculated according to the threshold voltage, and the current display voltage is compensated.

9 Claims, 2 Drawing Sheets

(56) References Cited

U.S. PATENT DOCUMENTS

| | | | | |
|---|---|---|---|---|
| 2017/0200414 | A1* | 7/2017 | Li | G09G 3/3233 |
| 2019/0073954 | A1 | 3/2019 | Kuang et al. | |
| 2020/0035154 | A1* | 1/2020 | Zeng | G09G 3/3233 |

FOREIGN PATENT DOCUMENTS

| | | | |
|---|---|---|---|
| CN | 107424566 | A | 12/2017 |
| CN | 107507574 | A | 12/2017 |
| CN | 107610648 | A | 1/2018 |
| CN | 109545148 | A | 3/2019 |
| KR | 20120069481 | A | 6/2012 |

OTHER PUBLICATIONS

Office Action dated Dec. 18, 2019 for Chinese Patent Application No. 201910067385.6 and English Translation.

* cited by examiner

METHOD AND DEVICE FOR COMPENSATING DISPLAY VOLTAGE

CROSS-REFERENCE TO RELATED APPLICATIONS

This application is a U.S. National Phase Entry of International Application No. PCT/CN2019/126209 having an international filing date of Dec. 18, 2019, which claims the priority to the Chinese Patent Application No. 201910067385.6, entitled "Method and Device for Compensating Display Voltage", filed on Jan. 24, 2019 by BOE TECHNOLOGY GROUP CO., LTD. The above-identified applications are incorporated by reference herein in their entirety.

TECHNICAL FIELD

The present disclosure relates to the field of display technology, in particular to a method and device for compensating display voltage.

BACKGROUND

An Active Matrix/Organic Light Emitting Diode (AMOLED) screen refers to a screen mainly made of AMOLED material, and AMOLED is an active matrix organic light emitting diode panel. Compared with a traditional liquid crystal panel, AMOLED has advantages of fast response, high contrast and wide viewing angle, etc.

SUMMARY

A first object of the present disclosure is to provide a method for compensating display voltage, so as to acquire a corresponding threshold voltage through a ratio of different detected voltages corresponding to the display voltages, calculate a compensation coefficient according to the threshold voltage, and compensate a current display voltage.

A second object of the present disclosure is to provide a device for compensating display voltage.

A third object of the present disclosure is to provide a computer program product.

A fourth object of the present disclosure is to provide a non-transitory computer readable storage medium.

In order to achieve the above objects, an embodiment of a first aspect of the present disclosure provides a method for compensating display voltage, including: acquiring a first detected voltage and a second detected voltage corresponding to display voltages of a first preset value and a second preset value respectively, and calculating a ratio of the first detected voltage to the second detected voltage; acquiring a threshold voltage corresponding to the ratio of the first detected voltage to the second detected voltage from a preset correspondence table; acquiring a current display voltage; calculating a compensation coefficient according to the threshold voltage; and compensating the current display voltage according to the threshold voltage and the compensation coefficient.

Compared with the prior art, in the embodiment of the present disclosure, the corresponding threshold voltage is acquired through the ratio of different detected voltages corresponding to the display voltages. The compensation coefficient is calculated according to the threshold voltage, and the current display voltage is compensated. A technical problem in the prior art that temperature affects the current display voltage and further affects a display effect is solved.

In addition, the method for compensating display voltage according to an embodiment of the present disclosure also has the following additional technical characteristics.

Optionally, the preset correspondence table is generated by the following steps: acquiring a third detected voltage and a fourth detected voltage corresponding to the display voltages of the first preset value and the second preset value respectively during shutdown; generating the threshold voltage corresponding to the ratio of the third detected voltage to the fourth detected voltage according to the following formula:

$$V_{th} = \frac{\sqrt{\frac{V1}{V2}} * data2 - data1}{\sqrt{\frac{V1}{V2}} - 1},$$

wherein, $V_{th}$ is the threshold voltage, V1 is the third detected voltage, V2 is the fourth detected voltage, $$\frac{V1}{V2}$$

is the ratio of the third detected voltage to the fourth detected voltage, data1 is the first preset value and data2 is the second preset value; and generating the preset correspondence table according to the ratio of the third detected voltage to the fourth detected voltage and the corresponding threshold voltage.

Optionally, calculating the compensation coefficient according to the threshold voltage includes: acquiring a voltage value generated randomly; adding the value of the threshold voltage to the voltage value generated randomly to acquire the value of an input voltage; acquiring a fifth detected voltage corresponding to the value of the input voltage; and calculating the compensation coefficient according to the following formula:

$$K = \frac{V}{V_{sense}},$$

wherein, K is the compensation coefficient, V is a value of a voltage corresponding to a preset display brightness, wherein the preset display brightness is a display brightness that a screen needs to achieve after the current display voltage is compensated, and $V_{sense}$ is the fifth detected voltage corresponding to the value of the input voltage.

Optionally, compensating the current display voltage according to the threshold voltage and the compensation coefficient includes: calculating the compensated current display voltage according to the following formula: data3=K*data+$V_{th}$, wherein data3 is the value of the compensated current display voltage, K is the compensation coefficient, data is a value of the current display voltage, and $V_{th}$ is the threshold voltage; changing the value of the current display voltage to the value of the compensated current display voltage.

An embodiment of a second aspect of the present disclosure provides a device for compensating display voltage, including: a first acquisition module, a first calculation module, a second acquisition module, a third acquisition module, a second calculation module, and a compensation module. The first calculation module is configured to acquire a first detected voltage and a second detected voltage corresponding to display voltages of a first preset value and a second preset value respectively. The first calculation module is configured to calculate a ratio of the first detected voltage to the second detected voltage. The second acquisition module is configured to acquire a threshold voltage corresponding to the ratio of the first detected voltage to the second detected voltage from a preset correspondence table. The third acquisition module is configured to acquire a current display voltage. The second calculation module is configured to calculate a compensation coefficient according to the threshold voltage. The compensation module is configured to compensate the current display voltage according to the threshold voltage and the compensation coefficient.

In addition, the device for compensating display voltage according to an embodiment of the present disclosure also has the following additional technical features.

Optionally, the device further includes a fourth acquisition module, a first generation module, and a second generation module for generating the preset correspondence table. The fourth acquisition module is configured to acquire a third detected voltage and a fourth detected voltage corresponding to the display voltages of the first preset value and the second preset value respectively during shutdown. The first generation module is configured to generate the threshold voltage corresponding to the ratio of the third detected voltage to the fourth detected voltage according to the following formula:

$$V_{th} = \frac{\sqrt{\frac{V1}{V2}} * data2 - data1}{\sqrt{\frac{V1}{V2}} - 1},$$

wherein, $V_{th}$ is the threshold voltage. V1 is the third detected voltage, V2 is the fourth detected voltage, $$\frac{V1}{V2}$$

is the ratio of the third detected voltage to the fourth detected voltage, data1 is the first preset value and data2 is the second preset value. The second generation module is configured to generate the preset correspondence table according to the ratio of the third detected voltage to the fourth detected voltage and the corresponding threshold voltage.

Optionally, the second calculation module includes: a first acquisition sub-module, an addition sub-module, a second acquisition sub-module, and a first calculation sub-module. The first acquisition sub-module is configured to acquire a voltage value generated randomly. The addition sub-module is configured to add a value of the threshold voltage to the voltage value generated randomly to acquire a value of an input voltage. The second acquisition sub-module is configured to acquire a fifth detected voltage corresponding to the input voltage value. The first calculation sub-module is configured to calculate the compensation coefficient according to the following formula:

$$K = \frac{V}{V_{sense}},$$

wherein, K is the compensation coefficient, V is a value of a voltage corresponding to a preset display brightness, wherein the preset display brightness is a display brightness that a screen needs to achieve after the current display voltage is compensated, and $V_{sense}$ is the fifth detected voltage corresponding to the value of the input voltage.

Optionally, the compensation module includes: a second calculation sub-module, and a change sub-module. The second calculation sub-module is configured to calculate the compensated current display voltage by using the following formula: data3=K*data+$V_{th}$, wherein data3 is the value of the compensated current display voltage, K is the compensation coefficient, data is a value of the current display voltage, and $V_{th}$ is the threshold voltage. The changing sub-module is configured to change the value of the current display voltage to the value of the compensated current display voltage.

An embodiment of a third aspect of the present disclosure provides a computer program product. When instructions in the computer program product are executed by a processor, the method for compensating display voltage as described in the foregoing method embodiment is implemented.

An embodiment of a fourth aspect of the present disclosure provides a non-transitory computer readable storage medium including a computer program stored thereon. When the computer program is executed by a processor, the method for compensating display voltage as described in the foregoing method embodiment is implemented.

Additional aspects and advantages of the present disclosure will be set forth in part in the following description, and will be apparent in part from the description, or may be learned through practice of the present disclosure.

BRIEF DESCRIPTION OF DRAWINGS

In order to describe technical solutions in embodiments of the present disclosure more clearly, the drawings to be used in the embodiments of the present disclosure will be introduced below in brief. Apparently, the drawings described below are only some of the embodiments of the present disclosure, and one skilled in the art may obtain other drawings according to these drawings without paying any inventive effort.

DETAILED DESCRIPTION

Figure 1:
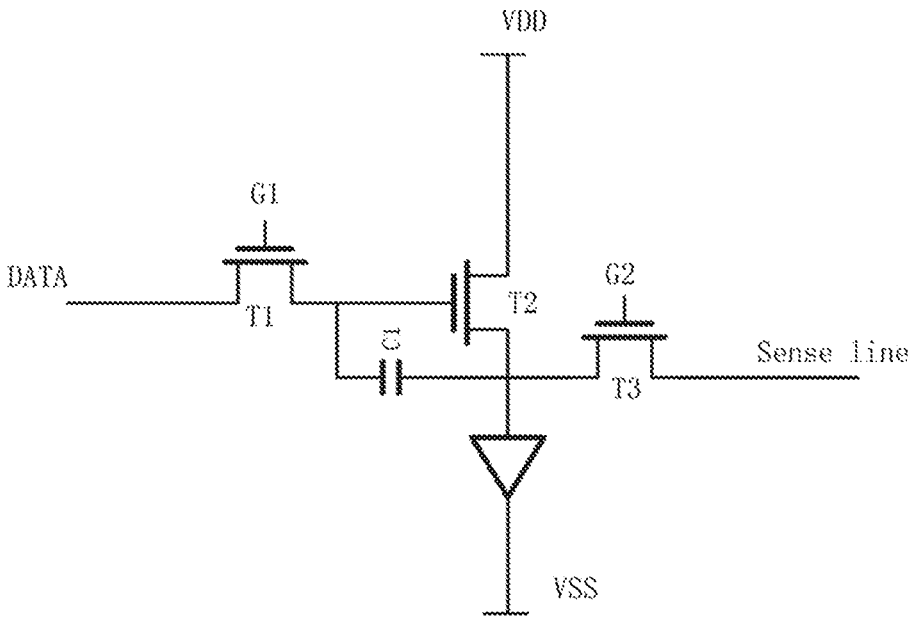
FIG. 1 is a schematic structural diagram of a compensation circuit according to an embodiment of the present disclosure.

Embodiments of the present disclosure are described in detail below, and examples of the embodiments are illustrated in the drawings, wherein same or similar reference numbers refer to same or similar elements or elements having same or similar functions throughout the drawings. Embodiments described below by referring to the drawings are exemplary and are intended to explain the present disclosure, and should not be construed as limiting the present disclosure.

A method and device for compensating display voltage according to embodiments of the present disclosure are described below with reference to the drawings.

Based on the above description of the prior art, it can be known that in the related art, AMOLED screens often have a problem of poor uniformity, and changes in temperature are easy to cause a threshold voltage drift, which affects a current display voltage and further affects a display effect.

With regard to this problem, an embodiment of the present disclosure provides a method for compensating display voltage, wherein a corresponding threshold voltage is acquired through a ratio of different detected voltages corresponding to display voltages, a compensation coefficient is calculated according to the threshold voltage, and a current display voltage is compensated.

It should be noted that in order to implement the method for compensating display voltage provided by the embodiment of the present disclosure, a compensation circuit is provided in an embodiment of the present disclosure. As shown in FIG. 1, VDD is used for inputting a threshold voltage, DATA is used for outputting a display voltage, Sense line is used for detecting a voltage, and VSS is used for grounding.

Figure 2:
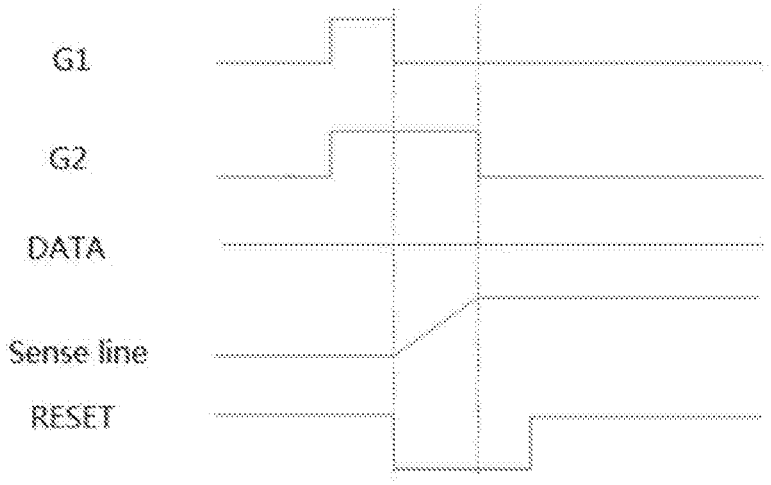
FIG. 2 is a schematic diagram of voltage value changes at various positions in a compensation circuit according to an embodiment of the present disclosure.

It should be noted that changes in the values of the voltages at various positions of the compensation circuit in FIG. 1 are shown in FIG. 2, wherein the voltage change in RESET is used for triggering to charge the Sense line. As long as a value of DATA is a constant, the changes in the values of the voltages at various positions of the compensation circuit in FIG. 1 conform to the changes shown in FIG. 2, but magnitudes of the changes in the values of the voltages at various positions are related to the value of DATA.

Figure 3:
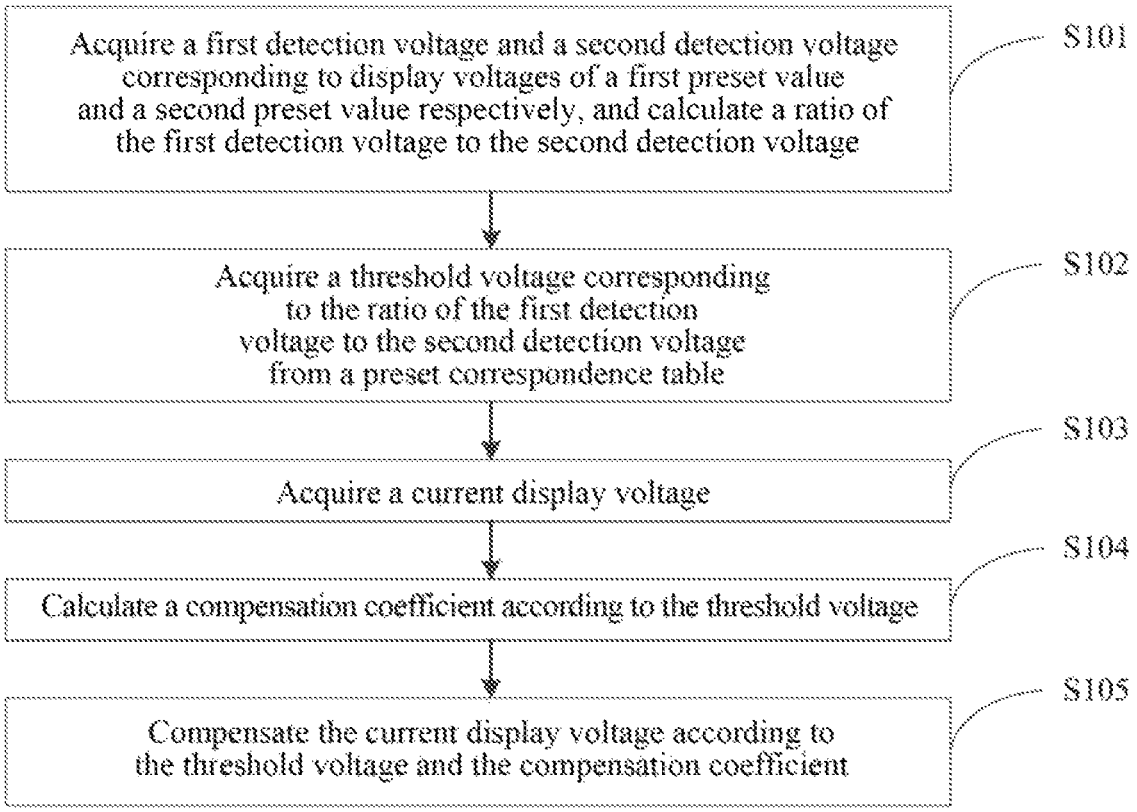
FIG. 3 is a schematic flowchart of a method for compensating display voltage according to an embodiment of the present disclosure.

FIG. 3 is a schematic flowchart of a method for compensating display voltage according to an embodiment of the present disclosure. As shown in FIG. 3, the method includes the following steps.

In S101, a first detected voltage and a second detected voltage corresponding to display voltages of a first preset value and a second preset value respectively are acquired, and a ratio of the first detected voltage to the second detected voltage is calculated.

The display voltage is the voltage of the DATA in FIG. 1. When the voltages of the DATA are the first preset value and the second preset value respectively, the corresponding voltages of the Sense line are the first detected voltage and the second detected voltage respectively.

At this time, the screen is in a normal operation, and the threshold voltage may have been drifted, so a real threshold voltage may not be acquired by measuring VDD directly.

In the method for compensating display voltage provided by the embodiment of the invention, the real threshold voltage is indirectly acquired by calculating the ratio of the first detected voltage to the second detected voltage.

In S102, a threshold voltage corresponding to the ratio of the first detected voltage to the second detected voltage is acquired from a preset correspondence table.

The preset correspondence table includes a correspondence relationship between the ratio of the first detected voltage to the second detected voltage and the real threshold voltage.

In order to generate the preset correspondence table, in a possible implementation, a third detected voltage and a fourth detected voltage corresponding to the display voltages of the first preset value and the second preset value respectively are acquired during shutdown.

It can be understood that acquiring the third detected voltage and the fourth detected voltage corresponding to the display voltages of the first preset value and the second preset value respectively during shutdown avoids an effect of temperature on a value of a detected voltage.

According to the following formula, a threshold voltage corresponding to the ratio of the third detected voltage to the fourth detected voltage is generated:

$$V_{th} = \frac{\sqrt{\frac{V1}{V2}} * data2 - data1}{\sqrt{\frac{V1}{V2}} - 1},$$

wherein $V_{th}$ is the threshold voltage, V1 is the third detected voltage, V2 is the fourth detected voltage, $$\frac{V1}{V2}$$

is the ratio of the third detected voltage to the fourth detected voltage, data1 is the first preset value and data2 is the second preset value. According to the ratio of the third detected voltage to the fourth detected voltage and the corresponding threshold voltage, the preset correspondence table is generated.

It should be noted that since the V1 and V2 satisfy the following formula:

$V1=K*T(data1-V_{th})^2$, $V2=K*T(data2-V_{th})^2$, wherein K represents mobility, T represents time, data1 and data2 represent the first preset value and the second preset value, respectively, and $V_{th}$ is the threshold voltage.

Since the mobility cannot be measured directly, but it may be canceled out by calculating the ratio, that is, $$\frac{V1}{V2} = \frac{(data1 - V_{th})^2}{(data2 - V_{th})^2},$$

the following formula may be acquired after mathematical transformation:

$$V_{th} = \frac{\sqrt{\frac{V1}{V2}} * data2 - data1}{\sqrt{\frac{V1}{V2}} - 1},$$

wherein, data1 and data2 are constants. Therefore, in the above formula, $$\sqrt{\frac{V1}{V2}}$$

may be regarded as an independent variable, and $V_{th}$ is regarded as a dependent variable, thereby obtaining the corresponding relationship between $V_{th}$ and $$\sqrt{\frac{V1}{V2}}.$$

In other words, when the value of $$\frac{V1}{V2}$$

changes, the magnitude of $V_{th}$ will also change.

Therefore, the correspondence relationship between $$\frac{V1}{V2}$$

and $V_{th}$ is recorded in the preset correspondence table. After determining the ratio of the first detected voltage to the second detected voltage, the real threshold voltage may be acquired by querying the preset correspondence table.

In S103, a current display voltage is acquired.

The current display voltage is a voltage that has not been compensated.

In S104, a compensation coefficient is calculated according to the threshold voltage.

In order to calculate the compensation coefficient corresponding to a preset display brightness, in a possible implementation, a voltage value generated randomly is acquired and the value of the threshold voltage is added to the voltage value generated randomly to acquire a value of an input voltage.

It should be understood that the screen cannot achieve the preset display brightness by the threshold voltage, and a voltage value needs to be added to the threshold voltage to make the screen achieve the preset display brightness. That is, a voltage value is added to the threshold voltage to be the value of the input voltage of VDD.

A fifth detected voltage corresponding to the value of the input voltage is acquired, wherein a value of the fifth detected voltage is affected by the mobility.

The compensation coefficient is calculated according to the following formula:

$$K = \frac{V}{V_{sense}},$$

wherein, K is the compensation coefficient, V is the value of the voltage corresponding to the preset display brightness, wherein the preset display brightness is a display brightness that the screen needs to achieve after the current display voltage is compensated, and $V_{sense}$ is the fifth detected voltage corresponding to the value of the input voltage.

It should be noted that the compensation coefficient here is essentially the same as the aforementioned mobility, and the compensation coefficient needs to be calculated to correct the display voltage just because of the existence of the aforementioned mobility.

S105, the current display voltage is compensated according to the threshold voltage and the compensation coefficient.

In a possible implementation, the compensated current display voltage is calculated by using the following formula: data3=K*data+$V_{th}$, wherein data3 is a value of the compensated current display voltage, K is the compensation coefficient, data is the value of the current display voltage, and $V_{th}$ is the threshold voltage.

The value of the current display voltage is changed to the value of the compensated current display voltage.

In summary, in the method for compensating display voltage provided by an embodiment of the present disclosure, a first detected voltage and a second detected voltage corresponding to display voltages of a first preset value and a second preset value respectively are acquired, and a ratio of the first detected voltage to the second detected voltage is calculated. A threshold voltage corresponding to the ratio of the first detected voltage to the second detected voltage is acquired from a preset correspondence table. A current display voltage and a preset display brightness are acquired, and a compensation coefficient corresponding to the preset display brightness is calculated according to the threshold voltage. According to the threshold voltage and the compensation coefficient, the current display voltage is compensated. Thus, the corresponding threshold voltage is acquired through the ratio of different detected voltages corresponding to the display voltages. The compensation coefficient is calculated according to the threshold voltage, and the current display voltage is compensated.

Figure 4:
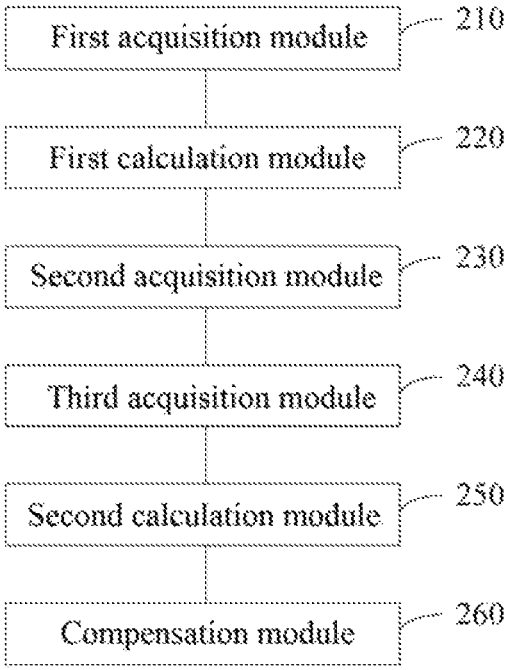
FIG. 4 is a schematic structural diagram of a device for compensating display voltage according to an embodiment of the present disclosure.

In order to realize the above embodiment, an embodiment of the present disclosure also provides a device for compensating display voltage. FIG. 4 is a schematic structural diagram of a device for compensating display voltage provided by an embodiment of the present disclosure. As shown in FIG. 4, the device includes a first acquisition module 210, a first calculation module 220, a second acquisition module 230, a third acquisition module 240, a second calculation module 250, and a compensation module 260.

The first acquisition module 210 is configured to acquire a first detected voltage and a second detected voltage corresponding to display voltages of a first preset value and a second preset value respectively.

The first calculation module 220 is configured to calculate a ratio of the first detected voltage to the second detected voltage.

The second acquisition module 230 is configured to acquire a threshold voltage corresponding to the ratio of the first detected voltage to the second detected voltage from a preset correspondence table.

The third acquisition module 240 is configured to acquire a current display voltage.

The second calculation module 250 is configured to calculate a compensation coefficient according to the threshold voltage.

The compensation module 260 is configured to compensate the current display voltage according to the threshold voltage and the compensation coefficient.

Furthermore, in order to generate the preset correspondence table, in a possible implementation, the device further includes a fourth acquisition module, a first generation module, and a second generation module to generate the preset correspondence table. The fourth acquisition module is configured to acquire a third detected voltage and a fourth detected voltage corresponding to the display voltages of the first preset value and the second preset value respectively during shutdown. The first generation module is configured to generate the threshold voltage corresponding to a ratio of the third detected voltage to the fourth detected voltage according to the following formula:

$$V_{th} = \frac{\sqrt{\frac{V1}{V2}} * \text{data2} - \text{data1}}{\sqrt{\frac{V1}{V2}} - 1},$$

wherein $V_{th}$ is the threshold voltage, V1 is the third detected voltage, V2 is the fourth detected voltage, $$\frac{V1}{V2}$$

is the ratio of the third detected voltage to the fourth detected voltage, data1 is the first preset value and data2 is the second preset value. The second generation module 290 is configured to generate the preset correspondence table according to the ratio of the third detected voltage to the fourth detected voltage and the corresponding threshold voltage.

Further, in order to calculate the compensation coefficient, in a possible implementation, the second calculation module 250 includes a first acquisition sub-module, an addition sub-module, a second acquisition sub-module, and a first calculation sub-module. The first acquisition sub-module is configured to acquire a voltage value generated randomly. The addition sub-module is configured to add a value of the threshold voltage to the voltage value generated randomly to acquire a value of an input voltage. The second acquisition sub-module is configured to acquire a fifth detected voltage corresponding to the value of the input voltage. The first calculation sub-module is configured to calculate the compensation coefficient corresponding to a preset display brightness according to the following formula:

$$K = \frac{V}{V_{sense}},$$

wherein, K is the compensation coefficient, V is a value of a voltage corresponding to the preset display brightness, wherein the preset display brightness is a display brightness that the screen needs to achieve after the current display voltage is compensated, and $V_{sense}$ is the fifth detected voltage corresponding to the value of the input voltage.

Further, in order to compensate the current display voltage, in a possible implementation, the compensation module 260 includes a second calculation sub-module and a change sub-module. The second calculation sub-module is configured to calculate the compensated current display voltage by using the following formula: data3=K*data+$V_{th}$, wherein, data3 is the value of the compensated current display voltage, K is the compensation coefficient, data is the value of the current display voltage, and $V_{th}$ is the threshold voltage. The change sub-module is configured to change the value of the current display voltage to the value of the compensated current display voltage.

It should be noted that the above illustration of the embodiment based on the method for compensating display voltage is also applicable to the device for compensating display voltage of this embodiment and will not be repeated here.

In summary, with the device for compensating display voltage provided by the embodiment of the present disclosure, the first detected voltage and the second detected voltage corresponding to the display voltages of the first preset value and the second preset value are acquired respectively, and a ratio of the first detected voltage to the second detected voltage is calculated. The threshold voltage corresponding to the ratio of the first detected voltage to the second detected voltage is acquired from the preset correspondence table. The current display voltage and the preset display brightness are acquired, and a compensation coefficient corresponding to the preset display brightness is calculated according to the threshold voltage. According to the threshold voltage and the compensation coefficient, the current display voltage is compensated. Thus, the corresponding threshold voltage is acquired through the ratio of different detected voltages corresponding to the display voltages. The compensation coefficient is calculated according to the threshold voltage, and the current display voltage is compensated.

In order to realize the above embodiment, an embodiment of the present disclosure also provides a computer program product. When instructions in the computer program product are executed by a processor, the method for compensating display voltage as described in the above method embodiment is implemented.

In order to realize the above embodiment, an embodiment also provides a non-transitory computer readable storage medium including a computer program stored thereon, when the computer program is executed by a processor, the method for compensating display voltage as described in the above method embodiment is implemented.

In the description of the present disclosure, it should be understood that the azimuth or position relationship indicated by the terms "center", "longitudinal", "transverse", "length", "width", "thickness", "on", "below", "front", "rear", "left", "right", "vertical", "horizontal", "top", "bottom", "inner", "outer", "clockwise", "counterclockwise", "axial", "radial", "circumferential" and the like is based on the azimuth or position relationship shown in the drawings. It is only for the convenience of describing the present disclosure and simplifying the description, but is not intended to indicate or imply that the device or element referred to must have the specific orientation, be constructed and operated in the specific orientation, and thus it cannot be interpreted as a limitation on the present disclosure.

In addition, the terms "first" and "second" are used for description purposes only, and cannot be interpreted as indicating or implying relative importance or implicitly indicating the number of technical features referred to. Thus, the features defined with "first" and "second" may include at least one of the features explicitly or implicitly. In the description of the present disclosure, the meaning of "multiple" is at least two, such as two, three, etc., unless otherwise specifically limited.

In the present disclosure, unless otherwise clearly specified and defined, the terms "install", "connect", "link", "fix" and other terms should be broadly interpreted, for example, it may be connected fixedly or connected detachably, or integrated; it may be a mechanical connection or an electrical connection; it may be directly connected, or may be indirectly connected through an intermediary, it may be an internal connection between two elements or an interaction between two elements, unless otherwise clearly specified. Those of ordinary skilled in the art can understand the specific meanings of the above terms in the present disclosure according to specific situations.

In the present disclosure, unless otherwise clearly specified and defined, that the first feature is "on" or "under" the second feature may be that the first and second features are in direct contact, or the first and second features are in indirect contact through an intermediary. Moreover, that the first feature is "over", "above" and "on" the second feature may be that the first feature is directly above or obliquely above the second feature, or simply means that a horizontal height of the first feature is higher than that of the second feature. That the first feature is "below", "beneath" and "under" the second feature may be that the first feature is directly below or obliquely below the second feature, or simply means that the horizontal height of the first feature is less than that of the second feature.

In the description of this specification, the description with reference to the terms "an embodiment," "some embodiments," "examples," "specific examples," or "some examples" and the like means that a specific feature, structure, material, or characteristic described in connection with the embodiment or example is included in at least one embodiment or example of the present disclosure. In this specification, the schematic illustration of the above-mentioned terms is not necessarily directed to the same embodiment or example. Moreover, the specific features, structures, materials, or characteristics described may be combined in any one or more embodiments or examples in a proper way. In addition, those skilled in the art may incorporate and combine different embodiments or examples and features of different embodiments or examples described in this specification if there is no conflict.

Although embodiments of the present disclosure have been shown and described above, it is to be understood that the above-mentioned embodiments are exemplary and should not be construed as limiting the present disclosure, and those of ordinary skilled in the art may make changes, modifications, substitutions and variations to the above-mentioned embodiments within the scope of the present disclosure.

What I claim is:

1. A method for compensating display voltage, comprising:

acquiring a first detected voltage and a second detected voltage corresponding to display voltages of a first preset value and a second preset value respectively, and calculating a ratio of the first detected voltage to the second detected voltage;

acquiring a threshold voltage corresponding to the ratio of the first detected voltage to the second detected voltage from a preset correspondence table;

acquiring a current display voltage;

calculating a compensation coefficient according to the threshold voltage; and compensating the current display voltage according to the threshold voltage and the compensation coefficient, wherein the preset correspondence table is generated by following steps:

acquiring a third detected voltage and a fourth detected voltage corresponding to the display voltages of the first preset value and the second preset value respectively during shutdown;

generating the threshold voltage corresponding to a ratio of the third detected voltage to the fourth detected voltage according to a following formula:

$$V_{th} = \frac{\sqrt{\frac{V1}{V2}} * \text{data2} - \text{data1}}{\sqrt{\frac{V1}{V2}} - 1},$$

wherein $V_{th}$ is the threshold voltage, V1 is the third detected voltage, V2 is the fourth detected voltage $$\frac{V1}{V2}$$

is the ratio of the third detected voltage to the fourth detected voltage, data1 is the first preset value and data2 is the second preset value; and generating the preset correspondence table according to the ratio of the third detected voltage to the fourth detected voltage and the corresponding threshold voltage.

2. The method of claim 1, wherein calculating the compensation coefficient according to the threshold voltage, comprises:

acquiring a voltage value generated randomly;

adding a value of the threshold voltage to the voltage value generated randomly to acquire a value of an input voltage;

acquiring a fifth detected voltage corresponding to the value of the input voltage; and calculating the compensation coefficient according to a following formula:

$$K = \frac{V}{V_{sense}},$$

wherein K is the compensation coefficient, V is a value of a voltage corresponding to a preset display brightness, wherein the preset display brightness is a display brightness that a screen needs to achieve after the current display voltage is compensated, and $V_{sense}$ is the fifth detected voltage corresponding to the value of the input voltage.

3. The method of claim 1, wherein compensating the current display voltage according to the threshold voltage and the compensation coefficient, comprises:

calculating the compensated current display voltage by using a following formula:

$$\text{data3} = K * \text{data} + V_{th},$$

wherein data3 is a value of the compensated current display voltage, K is the compensation coefficient, data is the value of the current display voltage and $V_{th}$ is the threshold voltage; and changing the value of the current display voltage to the value of the compensated current display voltage.

4. A device for compensating display voltage, comprising:

a first acquisition circuit, configured to acquire a first detected voltage and a second detected voltage corresponding to display voltages of a first preset value and a second preset value respectively;

a first calculation circuit, configured to calculate a ratio of the first detected voltage to the second detected voltage;

a second acquisition circuit, configured to acquire a threshold voltage corresponding to the ratio of the first detected voltage to the second detected voltage from a preset correspondence table;

a third acquisition circuit, configured to acquire a current display voltage;

a second calculation circuit, configured to calculate a compensation coefficient according to the threshold voltage; and a compensation circuit, configured to compensate the current display voltage according to the threshold voltage and the compensation coefficient, wherein the device further comprises following circuit for generating the preset correspondence table;

a fourth acquisition circuit, configured to acquire a third detected voltage and a fourth detected voltage corresponding to the display voltages of the first preset value and the second preset value respectively during shutdown;

a first generation circuit, configured to generate the threshold voltage corresponding to a ratio of the third detected voltage to the fourth detected voltage according to a following formula:

$$V_{th} = \frac{\sqrt{\frac{V1}{V2}} * \text{data2} - \text{data1}}{\sqrt{\frac{V1}{V2}} - 1},$$

wherein $V_{th}$ is the threshold voltage, V1 is the third detected voltage, V2 is the fourth detected voltage, $$\frac{V1}{V2}$$

is the ratio of the third detected voltage to the fourth detected voltage, data1 is the first preset value and data2 is the second preset value; and a second generation circuit, configured to generate the preset correspondence table according to the ratio of the third detected voltage to the fourth detected voltage and the corresponding threshold voltage.

5. The device of claim 4, wherein the second calculation circuit comprises:

a first acquisition sub-circuit, configured to acquire a voltage value generated randomly;

an addition sub-circuit, configured to add a value of the threshold voltage to the voltage value generated randomly to acquire a value of an input voltage;

a second acquisition sub-circuit, configured to acquire a fifth detected voltage corresponding to the value of the input voltage; and a first calculation sub-circuit, configured to calculate the compensation coefficient corresponding to a preset display brightness according to a following formula:

$$K = \frac{V}{V_{sense}},$$

wherein K is the compensation coefficient, V is a value of a voltage corresponding to the preset display brightness, wherein the preset display brightness is a display brightness that a screen needs to achieve after the current display voltage is compensated, and $V_{sense}$ is the fifth detected voltage corresponding to the value of the input voltage.

6. The device of claim 4, wherein the compensation circuit comprises:

a second calculation sub-circuit, configured to calculate the compensated current display voltage by using a following formula:

$$\text{data3} = K * \text{data} + V_{th},$$

wherein data3 is a value of the compensated current display voltage, K is the compensation coefficient, data is the value of the current display voltage and $V_{th}$ is the threshold voltage; and a change sub-circuit, configured to change the value of the current display voltage to the value of the compensated current display voltage.

7. A non-transitory computer readable storage medium comprising a computer program stored thereon, wherein when the computer program is executed by a processor, following steps are performed:

acquiring a first detected voltage and a second detected voltage corresponding to display voltages of a first preset value and a second preset value respectively, and calculating a ratio of the first detected voltage to the second detected voltage;

acquiring a threshold voltage corresponding to the ratio of the first detected voltage to the second detected voltage from a preset correspondence table;

acquiring a current display voltage;

calculating a compensation coefficient according to the threshold voltage; and compensating the current display voltage according to the threshold voltage and the compensation coefficient, wherein the preset correspondence table is generated by following steps:

acquiring a third detected voltage and a fourth detected voltage corresponding to the display voltages of the first preset value and the second preset value respectively during shutdown;

generating the threshold voltage corresponding to a ratio of the third detected voltage to the fourth detected voltage according to a following formula:

$$V_{th} = \frac{\sqrt{\frac{V1}{V2}} * \text{data2} - \text{data1}}{\sqrt{\frac{V1}{V2}} - 1},$$

wherein $V_{th}$ is the threshold voltage, V1 is the third detected voltage, V2 is the fourth detected voltage, $$\frac{V1}{V2}$$

is the ratio of the third detected voltage to the fourth detected voltage, data1 is the first preset value and data2 is the second preset value; and generating the preset correspondence table according to the ratio of the third detected voltage to the fourth detected voltage and the corresponding threshold voltage.

8. The non-transitory computer readable storage medium of claim 7, wherein calculating the compensation coefficient according to the threshold voltage, comprises:

acquiring a voltage value generated randomly;

adding a value of the threshold voltage to the voltage value generated randomly to acquire a value of an input voltage;

acquiring a fifth detected voltage corresponding to the value of the input voltage; and calculating the compensation coefficient according to a following formula:

$$K = \frac{V}{V_{sense}},$$

wherein K is the compensation coefficient, V is a value of a voltage corresponding to a preset display brightness, wherein the preset display brightness is a display brightness that a screen needs to achieve after the current display voltage is compensated, and $V_{sense}$ is the fifth detected voltage corresponding to the value of the input voltage.

9. The non-transitory computer readable storage medium of claim 7, wherein compensating the current display voltage according to the threshold voltage and the compensation coefficient, comprises:

calculating the compensated current display voltage by using a following formula:

$$\text{data3}=K*\text{data}+V_{th},$$

wherein data3 is a value of the compensated current display voltage, K is the compensation coefficient, data is the value of the current display voltage and $V_{th}$ is the threshold voltage; and changing the value of the current display voltage to the value of the compensated current display voltage.

* * * * *